US006933829B2

(12) United States Patent
Schöpf et al.

(10) Patent No.: US 6,933,829 B2
(45) Date of Patent: Aug. 23, 2005

(54) ELECTRICAL COMPONENT HAVING A PROTECTIVE LAYER

(75) Inventors: Harald Schöpf, Lienz (AT); Thomas Trenkler, Thal (AT); Chong Wang, Munich (DE)

(73) Assignee: Epcos AG, Munich (DE)

( * ) Notice: Subject to any disclaimer, the term of this patent is extended or adjusted under 35 U.S.C. 154(b) by 0 days.

(21) Appl. No.: 10/450,593

(22) PCT Filed: Dec. 13, 2001

(86) PCT No.: PCT/DE01/04688

§ 371 (c)(1),
(2), (4) Date: Dec. 29, 2003

(87) PCT Pub. No.: WO02/49047

PCT Pub. Date: Jun. 20, 2002

(65) Prior Publication Data

US 2004/0090303 A1 May 13, 2004

(30) Foreign Application Priority Data

Dec. 14, 2000 (DE) ..... 100 62 293

(51) Int. Cl.[7] ..... H01C 7/10
(52) U.S. Cl. ..... 338/22 R; 338/256; 338/257
(58) Field of Search ..... 338/22 R, 256, 338/257

(56) References Cited

U.S. PATENT DOCUMENTS 2,558,798 A * 7/1951 Thom ..... 338/250
2,640,132 A * 5/1953 Thom ..... 338/228
2,649,424 A * 8/1953 Brand ..... 106/251
2,664,324 A * 12/1953 Palmgren et al. ..... 384/562
2,664,364 A * 12/1953 Thom ..... 427/101
2,725,312 A * 11/1955 Schell ..... 428/422
2,731,312 A * 1/1956 Du Bois ..... 92/170.1
2,741,687 A * 4/1956 Toppari ..... 428/368
3,562,007 A * 2/1971 Bockstie, Jr. et al. ..... 428/215
3,670,091 A 6/1972 Frantz
3,824,328 A 7/1974 Ting
4,039,904 A 8/1977 Klein et al.
6,025,556 A * 2/2000 Yoshimura et al. ..... 174/52.2
6,400,253 B1 * 6/2002 Jinno et al. ..... 338/332

FOREIGN PATENT DOCUMENTS

| | | |
|---|---|---|
| DE | 51956 | 2/1889 |
| DE | 25 00 789 | 7/1975 |
| DE | 26 59 566 | 7/1977 |
| DE | 23 51 956 C2 | 12/1982 |
| DE | 40 29 681 A1 | 4/1992 |
| DE | 39 35 936 C2 | 10/1993 |
| EP | 0 322 339 | 12/1988 |

* cited by examiner

*Primary Examiner*—Karl D. Easthom
(74) *Attorney, Agent, or Firm*—Fish & Richardson P.C.

(57) ABSTRACT

An electrical component includes a base, connector elements connected to the base, an intermediate layer on a surface of the base, and a protective layer on the intermediate layer. The intermediate layer and the protective layer are produced from a same material. The material contains a solvent. The solvent has a negative affect on electrical properties of the component. The intermediate layer has a lower content of solvent than the protective layer.

18 Claims, 2 Drawing Sheets

ELECTRICAL COMPONENT HAVING A PROTECTIVE LAYER

CROSS-REFERENCE TO RELATED APPLICATIONS

This application claims priority to PCT application no. PCT/DE01/04688, which was filed on Dec. 13, 2001, and to German application no. 10062293.9, which was filed on Dec. 14, 2000.

FIELD OF THE INVENTION

The invention relates to an electrical component having a base, at least two connector elements connected to the base, and a protective layer. The invention also relates to a method for producing the electrical component.

BACKGROUND

Electrical components of the type described above are known. Such components are produced from ceramic material having a positive temperature coefficient. The bases of such components are sheathed with a protective layer containing organic ingredients. Such components are generally used as PTC resistors. Donator-doped and acceptor-doped barium titanate, for example, may be used as the ceramic material of such a PTC resistor. The protective layer is usually a dried varnish applied to the base via a dip-varnishing method. The dried varnish typically contains organic solvents, such as xylene or acetol ester, and organic binders.

From reference DE 25 00 789 A1, electrical components are known which have a compressible intermediate layer, onto which a protective layer is applied. The intermediate layer absorbs tension forces that act on the base, which result from different thermal expansion coefficients of the base and the protective layer. The intermediate layer can include a material containing a solvent. The solvent in the material is evaporated by heating the material following applying the intermediate layer to the base.

From patent DE 51 956 C2, a PTC resistor is known that is surrounded by a housing, the material of which is free of nucleophiles. The housing is also encapsulated by a casting material. This configuration prevents a chemical reaction of the housing material with the base of the PTC resistor.

The quality of PTC resistors is based on their voltage storage stability, among other things. Voltage storage stability is indicative of an electrical voltage that a PTC resistor can withstand over an extended period of time, such as 24 hours, without losing its characteristic properties. Current flowing through a PTC resistor, resulting from applied voltage, heats the PTC resistor. Thus, the voltage storage stability of a PTC resistor is closely linked with its temperature stability. Since chemical processes with significant time constants play a role in the assessment of the stability of a PTC resistor, an electrical voltage applied only over a short period of time does not provide enough information for an assessment of the stability of a PTC resistor.

Known components have a disadvantage in that the varnish applied as a protective layer has a relatively high layer thickness, e.g., between 10 and 500 $\mu$m. This is due to the method of applying the varnish, namely the dip varnishing method. Encrusted surfaces form when the varnish dries, while a portion of organic ingredients is still present in the interior of the varnish. The encrusted surfaces prevent the organic ingredients from leaving the varnish during the drying process.

The protective layer of known components thus contains a residue of organic ingredients. These ingredients can reach the base, and can cause a chemical reaction. The chemical reaction can occur if the temperature of the component exceeds 220° C. as a result of a very high applied voltage. The reaction can depolarize grain borders of the ceramic. This destroys the PTC effect of the ceramic, causing the component to overheat if the voltage continues to be applied. Overheating can destroy the component. Therefore, known components have poor voltage storage stability.

SUMMARY

It is therefore a goal of the present invention to provide a component that has a high voltage storage stability. It is also a goal of the invention to provide a method for producing such a component.

To this end, the invention is directed to an electrical component having a base and at least two connector elements that are connected to the base. An intermediate layer is arranged on a surface of the base. The intermediate layer has a protective layer on its surface. The intermediate layer and the protective layer are each made from the same material, which contains a solvent. The intermediate layer a lower content of the solvent than the protective layer.

The foregoing component has an advantage in that the two layers arranged on the surface of the base are produced from the same material. Using the same material results in cost savings. The component also has an advantage in that the intermediate layer making direct contact with the surface of the basic body has a lower solvent content than the protective layer. As a result, the base of the component, which can include, e.g., a ceramic material comes into contact with less solvent. As a result, negative effects of the solvent vis-à-vis the ceramic material can be reduced.

The intermediate layer arranged on the surface of the base can be applied to the base in such a way that the base is heated during application of the intermediate layer. This is advantageous because at least part of the solvent contained in the starting material can evaporate during application of the intermediate layer, making the intermediate layer on the surface dry quickly. This effectively reduces the content of solvent in the intermediate layer as compared with the content of solvent in the protective layer.

The foregoing configuration is particularly advantageous if the base is heated via an electrical current. PTC resistor ceramics are particularly suitable as a material for the base in this case, since PTC resistor ceramics are designed for stress resulting from high currents.

A varnish that contains an organic solvent can be used as a starting material for the intermediate layer or for the protective layer. Such varnishes are usually used as a protective layer for PTC resistors, which are structured using PTC resistor ceramics. The organic ingredients can be aromatic solvents, such as xylene, acetol ester, ethylene benzene, or also butanol, or organic binders, such as silicate rubber, among other things. Protective layers produced from such materials protect the component against ambient influences and demonstrate sufficient insulating properties, so that a short circuit is not produced between the connector elements by the protective layers. Varnishes that contain the organic ingredients described above, as well as inorganic fillers, such as $SiO_2$, may be used possible materials for protective layers.

It is advantageous if a protective layer is produced by dipping the base into a liquid, since this is a relatively easy way to produce an external protective layer with an appropriate thickness.

A suitable thickness for the protective layer, which is necessary for the protective function of the protective layer, is between 10 and 500 μm. A suitable thickness for the intermediate layer is between 5 and 100 μm.

The invention also provides a method for producing an electrical component. The component comprises a base that connects to at least two connector elements and that has an intermediate layer produced from a starting material that contains a solvent on its surface. The base is heated via an electrical current flowing through the base during application of the intermediate layer.

Heating of the base during application of the intermediate layer has the advantage that solvent contained in the starting material can easily evaporate, making it possible to reduce the solvent content of the intermediate layer and thereby also reduce adverse effects of the solvent on the surface of the base.

The foregoing method is particularly suitable for producing the intermediate layer of the component.

It is particularly advantageous to spray, on the base, the starting material for production of the intermediate layer. Any known spraying methods can be used, including the air brush method, for example. Spraying of the starting material makes it possible to apply the intermediate layer continuously and in a thin layer. A layer with a homogenous thickness is possible. Because the intermediate layer grows very slowly when it is applied by spraying, the content of solvent can evaporate relatively easily during application of the intermediate layer.

By spraying the intermediate layer, it is possible to surround the base of the component with the intermediate layer on all sides. This reduces the amount of moisture that reaches the base.

When applying the intermediate layer via spraying, it is particularly advantageous if the base is heated to a temperature that causes at least 90% of the solvent in the starting material to evaporate. This ensures that the intermediate layer contains only a very small proportion of solvent.

A uniform layer can be formed if the temperature of the base during application of the intermediate layer deviates from a suitable reference temperature by less than 10%. This ensures that, on the one hand, the temperature of the base is so high, at all times during the application process, that a sufficient amount of solvent is evaporated, and, on the other hand, that the temperature is so low that the intermediate layer and the base are not subject to thermal damage.

It is advantageous to use a base whose U-I characteristic has at least one maximum. It is then possible to produce an electrical current that flows through the base by applying an electrical voltage to the connector elements, which voltage lies in a range of a negative incline of the U-I characteristic. Because of the negative incline of the characteristic, an increase in the voltage results in a drop in the current flowing through the component. This has a stabilizing effect on the transformed electrical power P and also on the temperature of the component, i.e., of the base.

A base made of a PTC resistor ceramic may have a U-I characteristic with at least one maximum. The selection of an electrical voltage that lies in a range of negative incline of the U-I characteristic is known as "tipping" for PTC resistors.

Donator-doped barium titanate or also a $(V,Cr)_2O_3$ ceramic, for example, are possibilities for a suitable material for the ceramic with a positive temperature coefficient.

When using a base made from a PTC resistor ceramic, the base can be heated to a temperature between 140 and 150° C. by applying a current between 1 and 2 A. Such a temperature is suitable, for example, for spraying on a layer of silicate varnish.

A protective layer made of the same starting material can be applied to the intermediate layer using a different method, such as dipping. Such a protective layer can be made thicker than the intermediate layer and, consequently, is suitable as a protective layer against ambient influences.

By spraying the starting material onto the base, it is possible to apply the intermediate layer on all sides of the base. This effectively protects the base against other outer layers that contain solvent.

In the following, the invention will be explained in greater detail, using exemplary embodiments and the related figures.

DESCRIPTION

Figure 1:
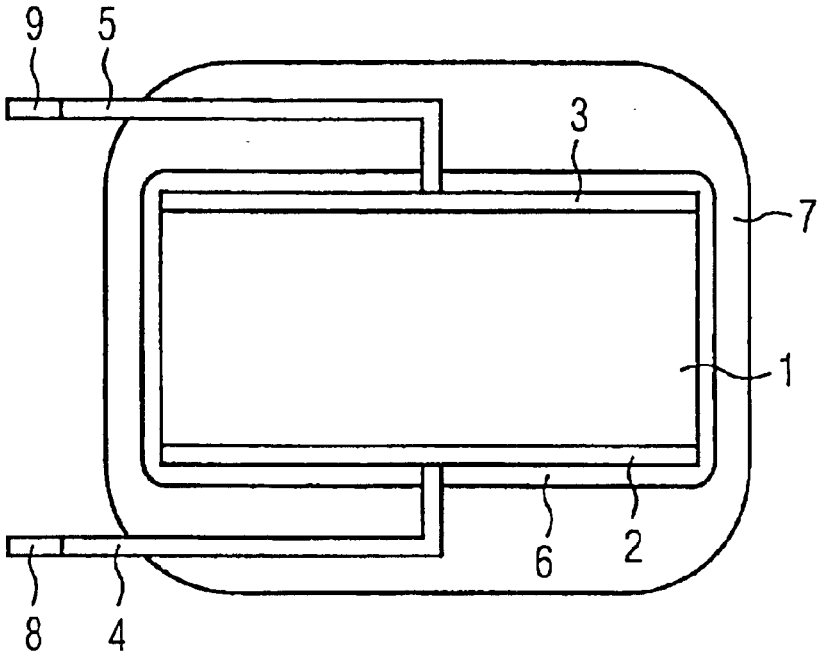
FIG. 1 shows a cross-sectional view of a component according to the invention.

FIG. 1 shows a PTC resistor having a disk-shaped base 1. Base 1 is made of a suitable ceramic. A first contact region 2 is provided on the bottom of base 1. First contact region 2 can include a silver baked enamel paste. A first connector element 4 is attached at first contact region 2. First connector element 4 can be a wire, for example. The attachment of such wire to first contact region 2 is preferably via soldering. A second contact region 3 is arranged on the top of base. Second contact region 3 can include a silver baked enamel paste. A second connector element 5, which can be a soldered wire, is attached at second contact region 3 in the same manner as first connector element 4 is connected to first contact region 2.

Base 1 is sheathed by a protective layer 7, which has a thickness of 10 to 500 μm and comprises a varnish containing a solvent. Base 1 is also sheathed by an intermediate layer 6 arranged within the protective layer 7. Intermediate layer 6 is between 5 and 20 μm thick and has only a very slight proportion of solvent. Connector elements 4, 5 have end segments 8, 9 that are not sheathed by either of layers 6, 7, so that they can serve as electrical contacts for the component.

In an exemplary embodiment, twenty of the components shown in FIG. 1 were produced as follows:

A PTC component was heated to a temperature between 140 and 150° C. using a current of 1 to 2 A. After the temperature stabilized, intermediate layer 6 was applied by spraying silicate varnish on base 1 using an air brush. Subsequently, protective layer 7 was produced by dipping the PTC, which had cooled again in the meantime, into silicate varnish and subsequently drying it.

Furthermore, twenty components according to FIG. 1, but without an intermediate layer, were produced as comparison samples.

The silicate varnish from the Reichold company was used to produce the protective layer, both for the exemplary embodiments of the invention and for the comparison samples. This varnish has been shown to lower the voltage storage stability of a component to a particular degree.

The storage of components at 20 V alternating current was tested for a period of 24 hours. In the case of the components with an intermediate layer, no failures were observed after this voltage storage test, while seven failures were observed for the components without an intermediate layer. This clearly shows the positive effect of the intermediate layer.

Figure 2:
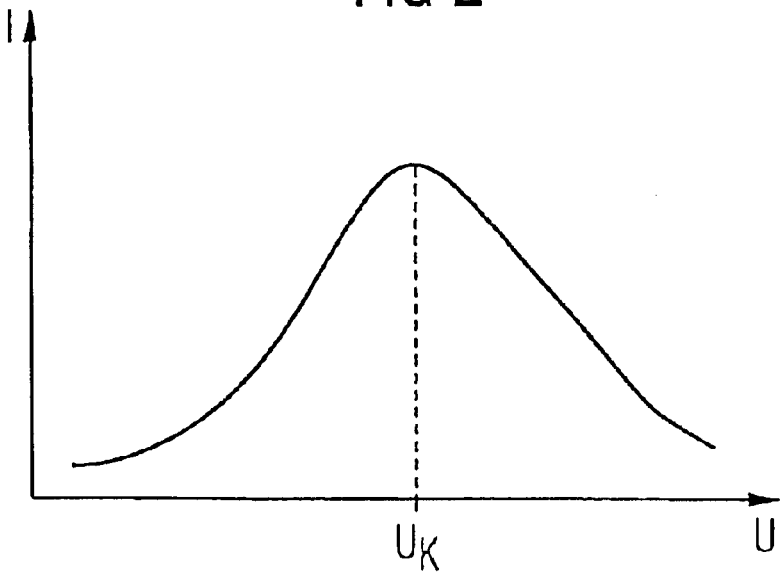
FIG. 2 shows the U-I characteristic of the component from FIG. 1.

The U-I characteristic according to FIG. 2 shows a maximum at a tip voltage UK. For voltages U>UK, the PTC resistor can be "tipped," which means that when the voltage U increases, the current I flowing through the PTC resistor decreases, and therefore the electrical power transformed in the component can be stabilized.

Figure 3:
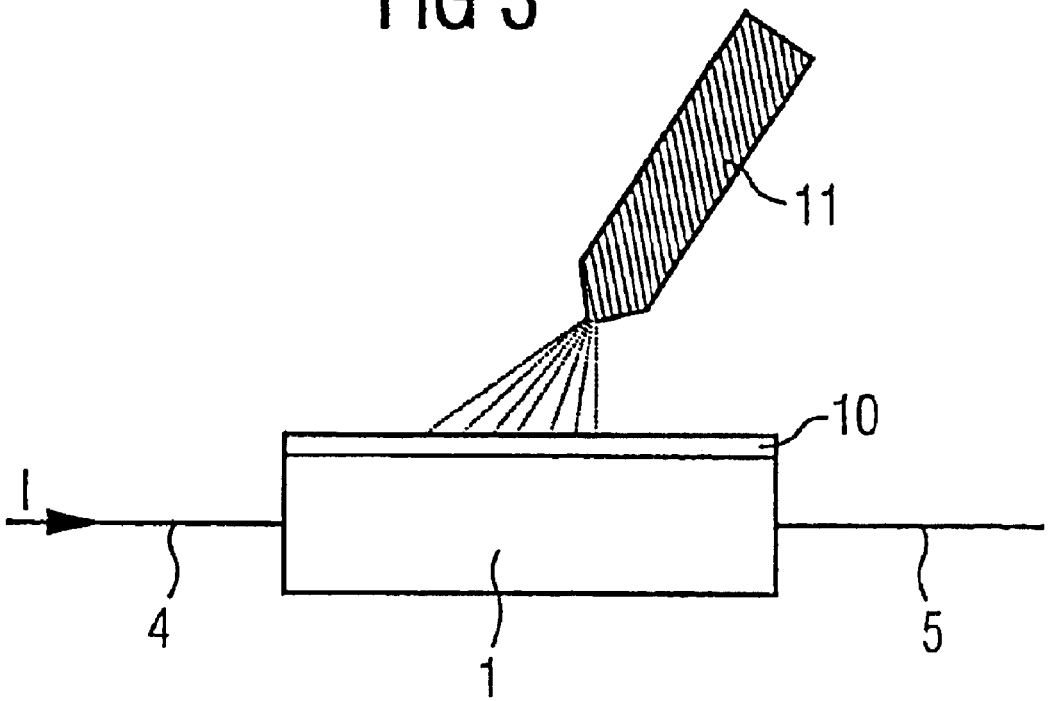
FIG. 3 shows a cross-sectional view of a component during application of a layer; using a method according to the invention.

FIG. 3 shows an implementation of the method according to the invention, in which base 1 made of a PTC resistor ceramic, which is provided with connector elements 4 and 5, has an electrical current I flowing through it. This electrical current I heats base 1 to a temperature above room temperature. Using a nozzle 11, silicate varnish is sprayed onto the surface of base 1, so that a layer 10 is formed. Layer 10 contains a very small amount of solvent as a result of evaporation.

What is claimed is:

1. An electrical component comprising:

a ceramic bulk base body;

connector elements electrically connected to the base body;

an intermediate layer directly on a surface of the base body; and a protective layer on the intermediate layer;

wherein the intermediate layer and the protective layer are produced from a same material, the material containing a solvent, the solvent having a negative effect on electrical properties of the component; and wherein the intermediate layer has a lower content of solvent than the protective layer when the intermediate layer and the protective layer are dry, a majority of the solvent in each layer driven off by an electric current passing through the base body.

2. The electrical component according to claim 1, wherein a thickness of the intermediate layer is between 5 and 100 $\mu$m.

3. The electrical component according to claim 1, wherein a thickness of the protective layer is between 10 and 500 $\mu$m.

4. An electrical component comprising:

a ceramic bulk base body;

a protective layer including a first solvent; and an intermediate layer disposed between the base body and the protective layer, the intermediate layer being in direct contact with a surface of the base body, the intermediate layer including a second solvent, the intermediate layer containing less of the second solvent proportionally than the protective layer contains of the first solvent when the intermediate layer and the protective layer are dry, a majority of the solvent in each layer driven off by an electric current passing through the base body.

5. The electrical component of claim 4, wherein the first solvent and the second solvent comprise a same material.

6. The electrical component of claim 4, wherein the electrical component comprises a PTC resistor.

7. The electrical component of claim 4, wherein the intermediate layer and the protective layer are formed of a same varnish.

8. The electrical component of claim 4, wherein the intermediate layer substantially encases the base and the protective layer substantially encases the intermediate layer.

9. The electrical component of claim 4, wherein the base has a U-I characteristic with at least one maximum.

10. The electrical component of claim 9, wherein the base comprises a PTC resistor ceramic.

11. The electrical component of claim 1, wherein the base has a U-I characteristic with at least one maximum.

12. The electrical component of claim 11, wherein the base comprises a PTC resistor ceramic.

13. The electrical component of claim 1, wherein the electrical component comprises a PTC resistor.

14. The electrical component of claim 1, wherein the intermediate layer and the protective layer are formed of a same varnish.

15. The electrical component of claim 1, wherein the intermediate layer substantially encases the base and the protective layer substantially encases the intermediate layer.

16. An electrical component comprising:

a base;

a contact region applied to the base;

connector elements electrically connected to the contact region;

an intermediate layer directly on a surface of the base and on the contact region; and a protective layer on the intermediate layer, the intermediate layer and the protective layer produced from a same material, the material containing a solvent, the solvent having a negative effect on electrical properties of the component, the intermediate layer having a lower content of solvent than the protective layer when the intermediate layer and protective layer are dry, a majority of the solvent in each layer driven off by an electric current passing through the base.

17. The electrical component according to claim 16, wherein the contact region is a baked enamel paste.

18. The electrical component according to claim 16, wherein the contact region consists of silver.

* * * * *